US008767065B2

(12) United States Patent
Yamamoto

(10) Patent No.: US 8,767,065 B2
(45) **Date of Patent: *Jul. 1, 2014**

(54) RECORDING APPARATUS HAVING LIQUID SUPPLY SYSTEM

(71) Applicant: Shinya Yamamoto, Nagoya (JP)

(72) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/627,767

(22) Filed: Sep. 26, 2012

(65) Prior Publication Data

US 2013/0106965 A1 May 2, 2013

(30) Foreign Application Priority Data

Oct. 31, 2011 (JP) ..... 2011-238787

(51) Int. Cl.
*B41J 29/13* (2006.01)

(52) U.S. Cl.
USPC ..... 348/108

(58) Field of Classification Search
USPC ..... 347/85, 104, 108; 400/691, 692, 693
See application file for complete search history.

(56) References Cited

U.S. PATENT DOCUMENTS 4,893,137 A 1/1990 Ebinuma et al.
5,166,707 A * 11/1992 Watanabe et al. ..... 347/3
5,909,226 A * 6/1999 Takeda ..... 347/3
6,190,010 B1 * 2/2001 Tanaka ..... 347/108
6,443,645 B1 9/2002 Takei et al.
6,739,692 B2 * 5/2004 Unosawa ..... 347/22
2006/0283695 A1 12/2006 Deshimaru
2009/0200735 A1 8/2009 Yamamoto
2010/0078877 A1 4/2010 Yamamoto et al.
2010/0079528 A1 4/2010 Yamamoto
2011/0193927 A1 8/2011 Matsushima et al.
2011/0242180 A1 10/2011 Yamamoto
2012/0105524 A1 5/2012 Yamamoto (Continued)

FOREIGN PATENT DOCUMENTS

EP 0271090 A2 6/1988
JP 2005-081546 A 3/2005

OTHER PUBLICATIONS

European Patent Office, extended European Search Report for European Patent Application No. 12186042.3 (counterpart European patent application), Dec. 21, 2012.

(Continued)

*Primary Examiner* — Anh T. N. Vo
(74) *Attorney, Agent, or Firm* — Baker Botts L.L.P.

(57) ABSTRACT

In a recording apparatus, a first casing holds a supporting portion. A second casing holds a recording head and a first tank. The second casing is connected to the first casing so as to be rotatable relative to the first casing about a prescribed axis, the second casing being configured to move between a first position and a second position by rotating relative to the first casing, the recording head being located adjacent to the first casing when the second casing is in the first position, the recording head being further apart from the first casing when the second casing is in the second position than when the second casing is in the first position. The recording head opposes the supporting portion when the second casing is in the first position. The second casing is provided with a second tank mounting portion and a liquid transferring portion.

9 Claims, 6 Drawing Sheets

(56) References Cited

U.S. PATENT DOCUMENTS

| | | | |
|---|---|---|---|
| 2012/0251166 | A1 | 10/2012 | Yamamoto et al. |
| 2012/0300005 | A1 | 11/2012 | Sugimoto et al. |
| 2013/0050381 | A1 | 2/2013 | Okumura et al. |
| 2013/0106967 | A1 | 5/2013 | Yamamoto |
| 2013/0106969 | A1 | 5/2013 | Yamamoto |
| 2013/0135390 | A1 | 5/2013 | Yamamoto |
| 2013/0135406 | A1 | 5/2013 | Yamamoto |

OTHER PUBLICATIONS

European Patent Office, extended European Search Report for European Patent Application No. 12186019.1 (counterpart European patent application), Dec. 21, 2012.

* cited by examiner

RECORDING APPARATUS HAVING LIQUID SUPPLY SYSTEM

CROSS REFERENCE TO RELATED APPLICATION

This application claims priority from Japanese Patent Application No. 2011-238787 filed Oct. 31, 2011. The entire content of this priority application is incorporated herein by reference.

TECHNICAL FIELD

The present invention relates to a recording apparatus for recording images on a recording medium by ejecting liquid from ejection openings.

BACKGROUND

There has been proposed an ink jet recording apparatus that has a first casing and a second casing. The first casing accommodates therein recording heads and subsidiary tanks for supplying ink to the recording heads. The second casing accommodates therein main tanks for storing ink to be supplied to the subsidiary tanks.

SUMMARY

In the ink jet recording apparatus described above, components constituting an ink supply system including the main tanks, the subsidiary tanks, and the recording heads exist across both of the first and second casings. Accordingly, pipes or tubes connecting the main tanks and the subsidiary tanks become long, and the entire ink supply system increases in size.

In view of the foregoing, it is an object of the present invention to provide a recording apparatus having a liquid supply system that is compact in size.

In order to attain the above and other objects, the invention provides a recording apparatus including: a supporting portion; a recording head; a first tank; a first casing; a second casing. The supporting portion is configured to support a recording medium. The recording head has an ejection surface formed with ejection openings, through which the recording head ejects liquid, the recording head being configured to record an image on a recording medium supported by the supporting portion by ejecting liquid from the ejection openings. The first tank is configured to store ink to be supplied to the recording head. The first casing holds the supporting portion. The second casing holds the recording head and the first tank. The second casing is connected to the first casing so as to be rotatable relative to the first casing about a prescribed axis, the second casing being configured to move between a first position and a second position by rotating relative to the first casing, the recording head being located adjacent to the first casing when the second casing is in the first position, the recording head being further apart from the first casing when the second casing is in the second position than when the second casing is in the first position. The recording head opposes the supporting portion when the second casing is in the first position. The second casing is provided with: a second tank mounting portion, into which a second tank is detachably mountable, the second tank being configured to store liquid; and a liquid transferring portion configured to transfer liquid from the second tank mounted in the second tank mounting portion to the first tank.

BRIEF DESCRIPTION OF THE DRAWINGS

The particular features and advantages of the invention as well as other objects will become apparent from the following description taken in connection with the accompanying drawings, in which:

FIGS. 5A and 5B show how the upper casing is rotated relative to the lower casing from the proximity position to the separation position, wherein FIG. 5A shows the state where the upper casing is in the proximity position and FIG. 5B shows the state where the upper casing is in the separation position.

DETAILED DESCRIPTION

An ink-jet printer according to one embodiment of the present invention will be described with reference to the accompanying drawings.

Figure 1:
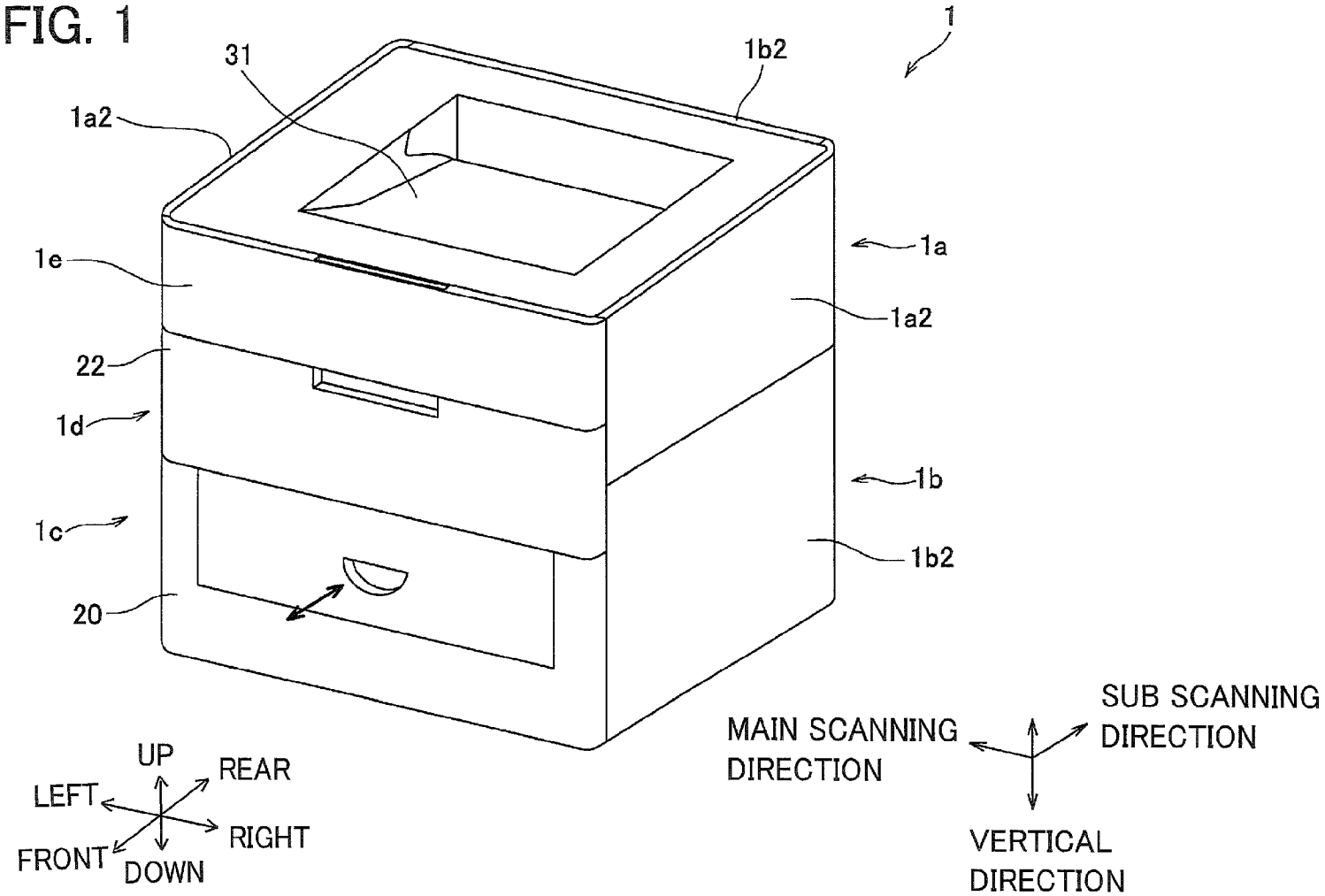
FIG. 1 is a perspective view showing an external appearance of an ink-jet printer according to an embodiment of the present invention, wherein an upper casing of the printer is positioned in a proximity position.

First will be described the overall configuration of the ink-jet printer 1 with reference to FIGS. 1 to 4. The terms "upward", "downward", "upper", "lower", "above", "below", "beneath", "right", "left", "front", "rear" and the like will be used throughout the description assuming that the ink-jet printer 1 is disposed in an orientation in which it is intended to be used. In use, the ink-jet printer 1 is disposed as shown in FIG. 1, in which a main scanning direction of the ink-jet printer 1 is parallel with the left-right direction, and a sub-scanning direction (or a direction perpendicular to the main scanning direction and the vertical direction) is parallel with the front-rear direction. The directions are defined also for cartridges 4 (which will be described later) so that the directions of the cartridges 4 are defined for when the cartridges 4 are mounted in the ink-jet printer 1.

The printer 1 includes an upper casing 1*a* and a lower casing 1*b*. The upper casing 1*a* and the lower casing 1*b* both are in the shape of a rectangular parallelepiped and substantially equal in size. A lower surface of the upper casing 1*a* is opened. An upper surface of the lower casing 1*b* is opened. The upper casing 1*a* is stacked on the lower casing 1*b*, thereby sealing the opening surfaces of both. As a result, a space inside the printer 1 is defined (See FIG. 3).

A sheet discharging portion 31 is provided on a top panel of the upper casing 1*a*. In the internal space of the printer 1, as indicated by bold broken arrows in FIG. 3, a conveying path is formed to convey a paper sheet P from a first sheet supply portion 1*c* and a second sheet supply portion 1*d* to the sheet discharging portion 31.

Figure 4:
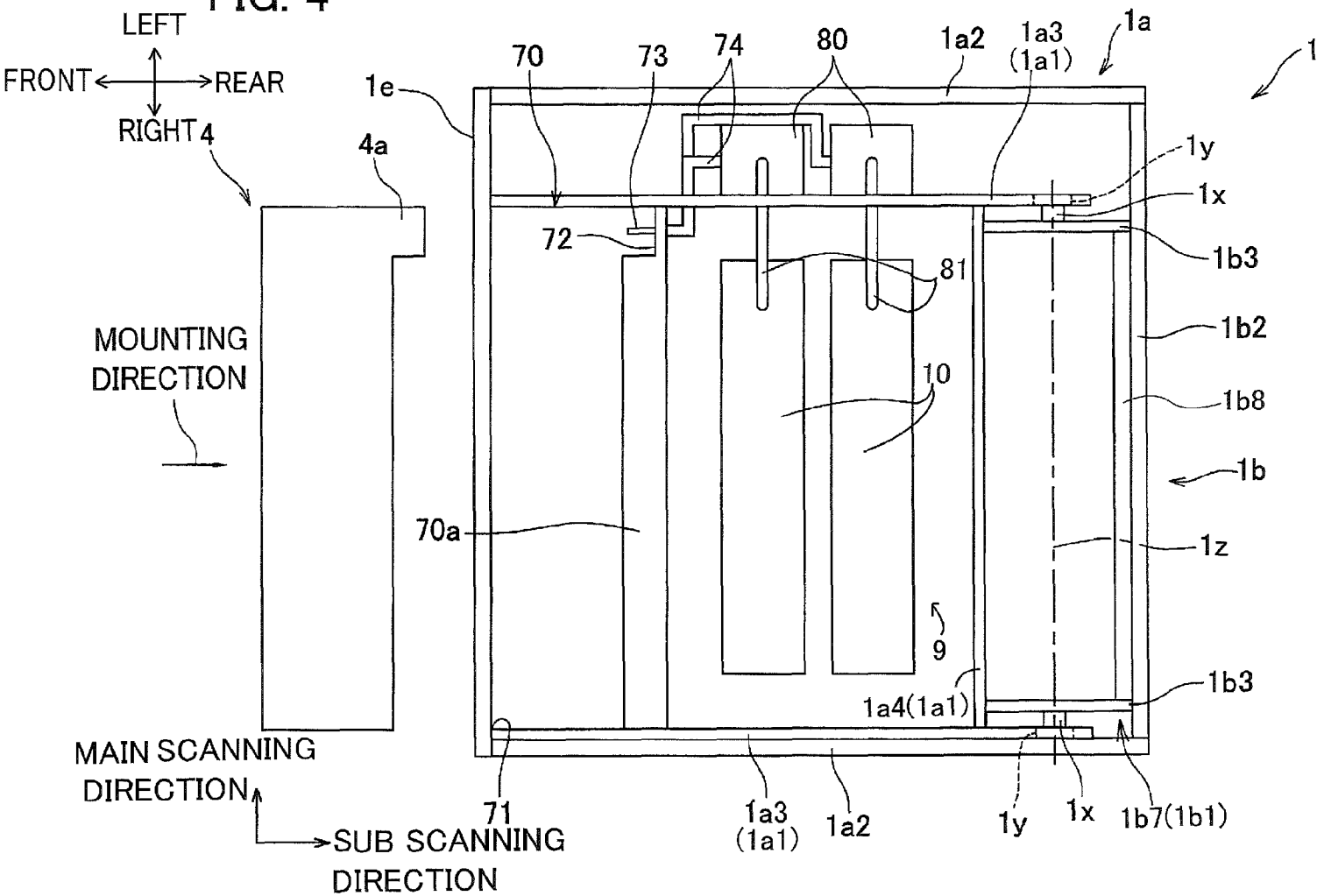
FIG. 4 is a schematic plan view schematically showing the internal configuration of the printer.

The upper casing 1*a* includes an upper-casing frame 1*a*1 (See FIG. 4) and an upper-casing decorative panel 1*a*2. The upper-casing decorative panel 1*a*2 is fixed to the upper-casing frame 1*a*1 on the outside of the upper-casing frame 1*a*1. As shown in FIG. 4, the upper-casing frame 1*a*1 includes: a pair of upper-casing rigid frames 1*a*3 that oppose with each other in the main scanning direction and that are high in strength; and an upper-casing connection frame 1*a*4 that connects the pair of upper-casing rigid frames 1*a*3 with each other.

The lower casing 1*b* includes a lower-casing frame 1*b*1 (See FIGS. 2-4) and a lower-casing decorative panel 1*b*2. The lower-casing decorative panel 1*b*2 is fixed to the lower-casing frame 1*b*1 on the outside of the lower-casing frame 1*b*1. The lower-casing frame 1*b*1 includes: a pair of lower-casing rigid frames 1*b*7 that oppose with each other in the main scanning direction and that are high in strength; and a lower-casing connection frame 1*b*8 that connects the pair of lower-casing rigid frames 1*b*7 with each other.

Figure 2:
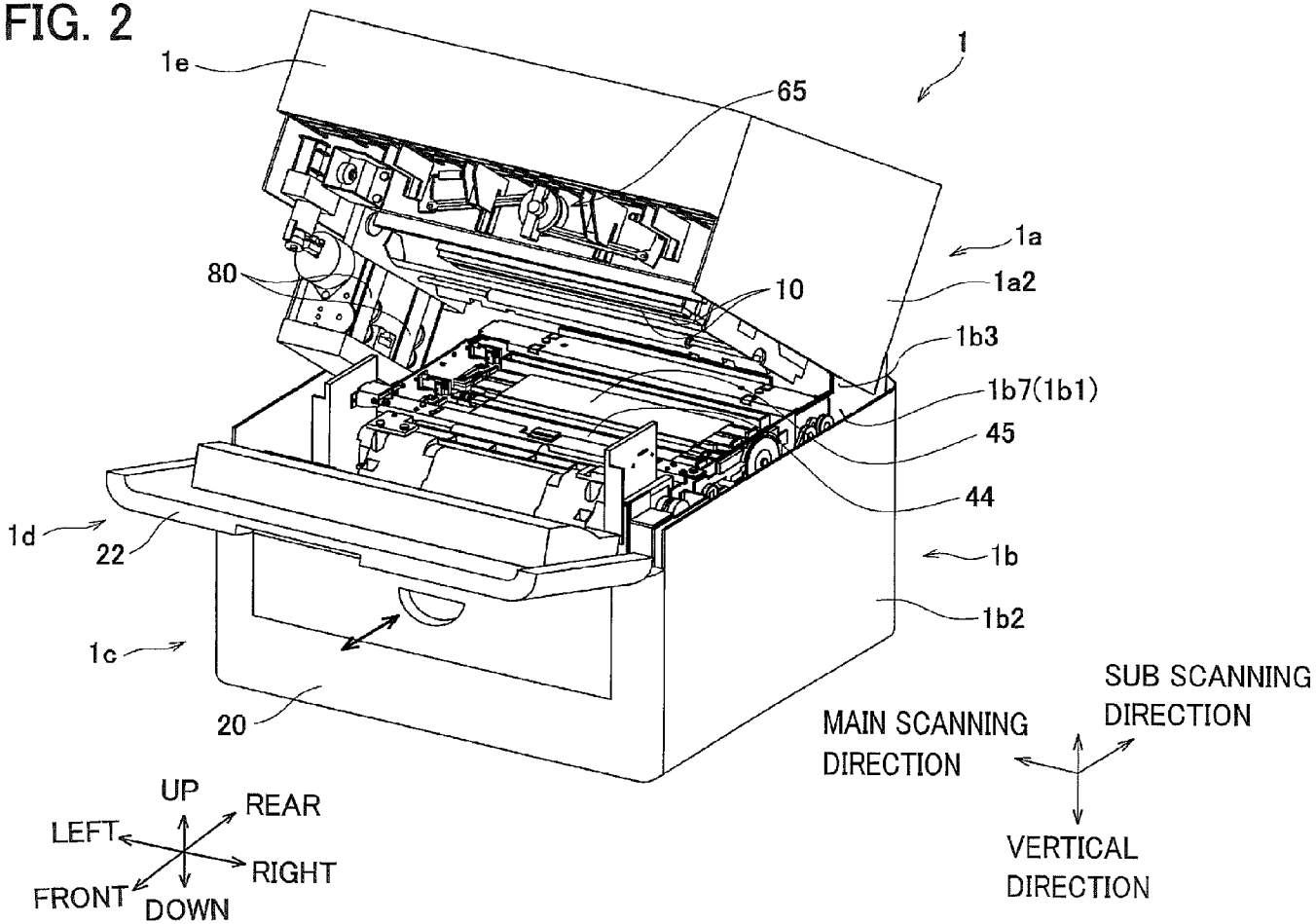
FIG. 2 is a perspective view showing the external appearance of the ink-jet printer of FIG. 1, wherein the upper casing is positioned in a separation position.

The lower-casing frame 1*b*1 supports a conveying mechanism 40 (described later), and is the most rigid of all the frames. As shown in FIGS. 2 and 5A, the lower-casing frame 1*b*1 has a reverse L-shape in a side view when seen in the main scanning direction. More specifically, each of the lower-casing rigid frames 1*b*7 is a plate of a reverse L shape, and extends both in the front-rear direction and in the vertical direction. As shown in FIG. 5A, the reverse L shape has a bottom side part 1*b*9 that extends in the front-rear direction and a protruding part 1*b*3 that protrudes upwardly from a rear side end of the bottom side part. While the bottom side part 1*b*9 is positioned at the lower casing side, the protruding part 1*b*3 protrudes into the upper casing side 1*a*. The bottom side part in the lower-casing rigid frame 1*b*7 will be referred to as a "lower-frame main portion 1*b*9". The upwardly protruding part in the lower-casing rigid frame 1*b*7 will be referred to as a "lower-frame projecting portion 1*b*3". Thus, the pair of lower-casing rigid frames 1*b*7 have a pair of lower-frame main portions 1*b*9 and a pair of lower-frame projecting portions 1*b*3. The lower-frame projecting portions 1*b*3 project upwardly from the rear side ends of the lower-frame main portions 1*b*9. The pair of lower-frame projecting portions 1*b*3 also constitute a highly rigid frame portion. It is noted that in FIG. 4, only the lower-frame projecting portions 1*b*3 and the lower-casing connection frame 1*b*8 are shown, but the remaining part of the lower-casing frame 1*b*1 is not shown, in order to facilitate understanding the internal configuration of the printer 1.

Figure 3:
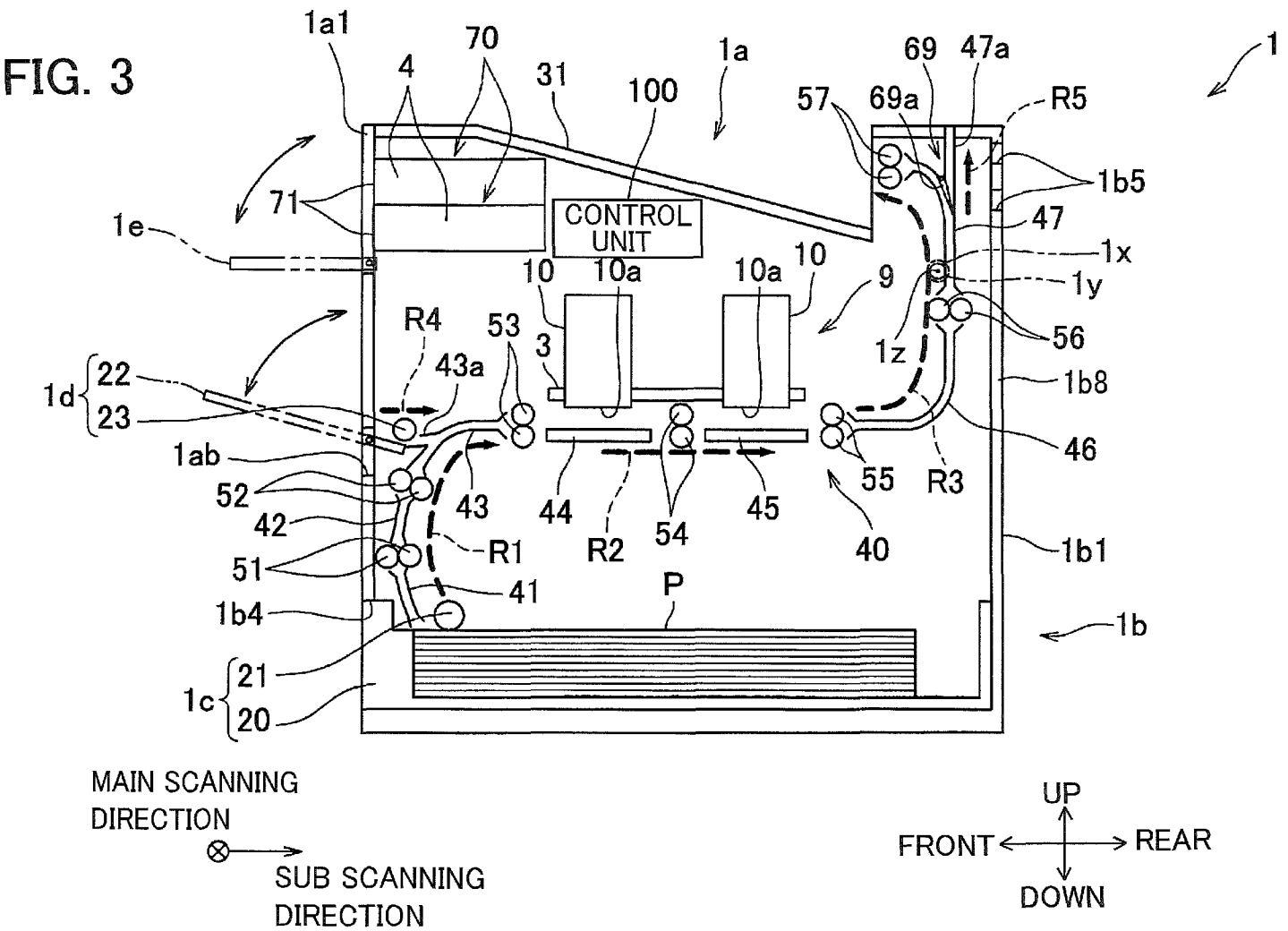
FIG. 3 is a side view schematically showing the internal configuration of the printer.

As shown in FIGS. 3 and 5A, the upper casing 1*a* is connected to the lower casing 1*b* through shafts (pivot shafts) 1*x*. The shafts 1X are disposed in the upper casing 1*a* at such a position that is on a rear side end portion in the front-rear direction and substantially at a center in the vertical direction. The shafts 1*x* extend in the main scanning direction. The upper casing 1*a* is rotatable about an axis 1*z* of the shaft 1*x* relative to the lower casing 1*b*. The upper casing 1*a* can rotate between a proximity position shown in FIGS. 1, 3, and 5A, in which the upper casing 1*a* is adjacent to the lower casing 1*b*, and a separation position shown in FIGS. 2 and 5B, in which the upper casing 1*a* is farther away from the lower casing 1*b* than when the upper casing 1*a* is in the proximity position. When the upper casing 1*a* is in the proximity position, the liquid ejection surfaces 10*a* of the heads 10 extend along the horizontal plane and oppose the upper surfaces of the platens 44 and 45 (to be described later) in the vertical direction. When the upper casing 1*a* is in the separation position, part of the paper sheet conveying path is exposed to outside, thereby securing a working space for a user on the paper sheet conveying path formed inside the upper and lower casings 1*a* and 1*b*. Using the working space, the user can manually carry out a jam operation (or an operation of removing a paper sheet P jammed on the conveying path).

As shown in FIG. 4, the shafts 1*x* project outwardly in the main scanning direction from outer-side surfaces of the pair of lower-frame projecting portions 1*b*3 in the main scanning direction. Thus, the shafts 1*x* are provided on the highly rigid projecting portions 1*b*3. Each shaft 1*x* extends in the main scanning direction, and the axis 1*z* of the shaft 1*x* also extends in the main scanning direction.

The upper-casing frame 1*a*1 is provided with a pair of bearings 1*y*. The bearings 1*y* support the shafts 1*x* so that the shafts 1*x* can rotate relative to the bearings 1*y*. The shafts 1*x* and the bearings 1*y* connect the upper casing 1*a* and the lower casing 1*b* together in such a way that the upper casing 1*a* and the lower casing 1*b* are rotatable relative to each other.

Springs (not shown) are provided on the shafts 1*x* to urge the upper casing 1*a* in a direction to rotate the upper casing 1*a* from the proximity position toward the separation position, that is, to open the upper casing 1*a*. According to the present embodiment, the upper casing 1*a* can open until the upper casing 1*a* reaches a predetermined angle relative to the horizontal plane. That is, the upper casing 1*a* can open until the angle θ formed between the upper casing 1*a* and the lower casing 1*b* becomes the predetermined angle. The predetermined angle is such an amount that allows a user to put his/her hand into between the upper casing 1*a* and the lower casing 1*b* to carry out a jam operation. According to the present embodiment, the predetermined angle is 29 degrees.

As shown in FIG. 2, a lock mechanism 65 is provided on a front surface of the upper casing 1*a*. The lock mechanism 65 restricts the upper casing 1*a* from rotating when the upper casing 1*a* is located at the proximity position. A door 22 is provided on the front surfaces of the upper and lower casings 1*a* and 1*b* to partially cover the front surfaces and able to be opened and closed. When the door 22 is opened, the lock mechanism 65 is exposed. When the lock by the lock mechanism 65 is released, the upper casing 1*a* becomes able to rotate relative to the lower casing 1*b*. After the upper casing 1*a* goes back to the proximity position, the lock mechanism 65 automatically restricts the rotation of the upper casing 1*a*. Incidentally, the door 22 also serves as a manual feed tray 22 in the second sheet supply portion 1*d* as described later.

Next will be described, with reference to FIGS. 3 and 4, respective components disposed in the internal space of the printer 1.

There are disposed in the internal space of the printer 1: a control unit 100; the conveying mechanism 40; a head unit 9; two sub-tanks 80; two cartridges 4; two cartridge mounting portions 70; the first sheet supply portion 1*c*; and the second sheet supply portion 1*d*. The control unit 100 controls each portion in the printer 1. The conveying mechanism 40 defines the conveying path of a paper sheet P. The head unit 9 includes the two heads 10 for ejecting liquid. The two sub-tanks 80 correspond to the two heads 10. The two cartridges 4 correspond to the two sub-tanks 80. The two cartridges 4 are detachably mountable in the two cartridge mounting portions 70, respectively. The upper casing 1*a* retain the control unit 100, the head unit 9, the two sub-tanks 80, and the two cartridges 4. The lower casing 1*b* retain the conveying mechanism 40 and the first and second sheet supply portions 1*c* and 1*d*.

The control unit 100 controls: a preparation operation pertaining to recording; an operation of supplying, conveying, and discharging paper sheets P; and a liquid ejection operation and any other operations to record images on the paper sheets P based on a recording command supplied from an external device (a personal computer connected to the printer 1, for example). The liquid ejection operation is performed in synchronization with the operation of conveying the paper sheets P.

The control unit 100 includes a CPU (Central Processing Unit) that works as an arithmetic processing device. The control unit 100 also includes a ROM (Read Only Memory), a RAM (Random Access Memory: including a nonvolatile RAM), an I/F (Interface), and an I/O (Input/Output Port). The ROM stores therein programs executed by the CPU, and various kinds of fixed data. The RAM temporarily stores therein data such as image data that is used when programs are executed. The CPU is provided with an ASIC, which performs a process of rewriting and/or rearranging image data, such as a signal processing and an image processing. The I/F transmits data to an external device, and receives data from the external device. The I/O inputs and outputs detection signals of various sensors.

The conveying path defined by the conveying mechanism 40 includes: paths R1, R2, and R3; a path R4; and a path R5. The paths R1, R2, and R3 are used for normal conveyance. The path R4 is for connecting the second sheet supply portion 1*d* to the path R1. The path R5 is connected to a sheet discharge tray 200 when the sheet discharge tray 200 (described later; see FIG. 6) is added to the printer 1. The conveying mechanism 40 includes a conveying motor (not shown), and components (described later) defining the paths R1 and R5. The conveying mechanism 40 is retained by the lower-casing frame 1*b*1. Especially, the paths R3 and R5 are retained by the pair of lower-frame projecting portions 1*b*3.

The path R1 extends from the first sheet supply portion 1*c* to recording positions, where a sheet of paper P faces the liquid ejection surfaces 10*a*, and is curved in a U-shape when seen from the main scanning direction. The path R1 is defined by guides 41 to 43, and pairs of rollers 51 to 53.

The path R2 runs through the recording positions of the two heads 10, or between the heads 10 and platens 44 and 45. The path R2 is defined by the platens 44 and 45 and a pair of rollers 54. The platens 44 and 45 face the liquid ejection surfaces 10*a* of the heads 10.

The path R3 extends from the recording positions to the sheet discharging portion 31 and is curved in a U-shape when seen from the main scanning direction. The path R3 is defined by guides 46 and 47, and pairs of rollers 55 to 57. The path R3 is positioned at a level higher than the recording positions in terms of the vertical direction. In other words, the path R3 is on the same side as the liquid ejection surfaces 10*a* relative to the recording positions. The path R3 is curved in a direction opposite to the path R1. That is, as shown in FIG. 3, while the path R1 is so curved as to bulge frontward (or is curved in a U-shape with the bottom of the U-shape positioned on the front side), the path R3 is so curved as to bulge rearward (or is curved in a U-shape with the bottom of the U-shape positioned on the rear side). As a result, the paths R1 to R3 overall are in a reverse S shape.

The path R4 extends from the second sheet supply portion 1*d* to a middle portion of the path R1, and is defined by a branching guide 43*a* that branches from the guide 43.

The path R5 extends vertically upward from a middle portion of the path R3 and is defined by a branching guide 47*a* that branches from the guide 47.

The pairs of rollers 51 to 57 each include a driving roller and a following roller: the driving roller is connected to the conveying motor, and the following roller rotates as the driving roller rotates.

Incidentally, in a portion where the path R3 is connected to the path R5, a switching mechanism 69 is provided to switch the conveying paths of the paper sheet P. The switching mechanism 69 includes a swing member 69*a* and a driving unit (not shown). The swing member 69*a* swings between the first position (or the position shown in FIG. 3) and the second position (or the position shown in FIG. 6) where the paths R3 and R5 communicate with each other. The driving unit drives the swing member 69*a*. The driving unit of the switching mechanism 69 is controlled by the control unit 100. In order to discharge a paper sheet P onto the sheet discharging portion 31, the swing member 69*a* is located at the first position. In order to discharge a paper sheet P onto the sheet discharge tray 200, the swing member 69*a* is located at the second position.

Thus, the lower-casing frame 1*b*1 retains: the guides 41 to 43, pairs of rollers 51 to 53, platens 44 and 45, pair of rollers 54, guides 46 and 47, pairs of rollers 55 to 57, the branching guide 43*a*, branching guide 47*a*, and switching mechanism 69.

The head unit 9 includes the two heads 10 and a carriage 3 that supports the heads 10. The two heads 10 include a pre-coating head and an ink-jet head which are arranged in this order in the sheet conveying direction from its upstream side to its downstream side. The pre-coating head is for ejecting pretreatment liquid, while the ink-jet head is for ejecting black ink.

The heads 10 have the same configuration with each other. The heads 10 are of a line type, and are long in the main scanning direction. The outer shape of the heads 10 is substantially a rectangular parallelepiped. The heads 10 are fixedly mounted on the carriage 3 such that the heads 10 are separate from each other in the sub-scanning direction. The carriage 3 is supported by the upper-casing frame 1*a*1.

As shown in FIG. 3, the heads 10 are oriented so that the liquid ejection surfaces 10*a* are parallel to the horizontal plane and face vertically downwardly. Each liquid ejection surface 10*a* is formed with many ejection nozzles (ejection openings). Flow channels are formed inside each head 10. Pretreatment liquid and black ink, which will be collectively referred to as "liquid," hereinafter, are supplied from the cartridges 4 to the heads 10, and flow through the flow channels, before reaching the ejection nozzles. The pretreatment liquid is for preventing bleeding and strike-through of ink, and for improving color development and quick-drying characteristics of ink.

The sub-tanks 80 are for storing liquid supplied from the cartridges 4. As shown in FIGS. 2 and 4, the sub-tanks 80 are disposed side by side with the heads 10 in terms of the main scanning direction. As shown in FIG. 4, in terms of the main scanning direction, the sub-tanks 80 are disposed at one edge side (left edge side) in the upper casing 1*a* with respect to the center of the upper casing 1*a*. The sub-tanks 80 are supported by the upper-casing frame 1*a*1 at a position outside the upper-casing frame 1*a*1 in the main scanning direction. The sub-tanks 80 are connected with the heads 10 via pipes 81. The sub-tanks 80 are for supplying liquid to the heads 10.

The two cartridge mounting portions 70 are disposed adjacent to each other in the vertical direction, and are provided between the pair of upper-casing rigid frames 1*a*3 in the upper-casing frame 1*a*1. In terms of the vertical direction, the cartridge mounting portions 70 are disposed at a position higher than the heads 10 and the sub-tanks 80 (See FIG. 5A). That is, the sub-tanks 80 are placed at a position lower than the cartridge mounting portions 70 or the cartridges 4 mounted in the cartridge mounting portions 70. As a result, liquid is supplied naturally from the cartridges 4 to the sub-tanks 80.

As shown in FIG. 4, in planar view, the cartridge mounting portions 70 are long and extend in the main scanning direction, similarly to the heads 10. In terms of the main scanning direction, the cartridge mounting portions 70 are so disposed as to overlap with the heads 10 when seen in the sub-scanning direction. So, the space inside the upper casing 1*a* can be used in an effective manner even though the heads 10 are long in the main scanning direction. Accordingly, in terms of the main scanning direction, the upper casing 1*a* is small in size.

Mounting ports 71 of the cartridge mounting portions 70 are formed on a front surface of the upper casing 1*a*, i.e. on a side face that is farthest away from the shafts 1*x* in terms of the sub-scanning direction. The mounting ports 71 are covered with a door 1*e*. The door 1*e* is a plate like member that is supported rotatably on the upper casing 1*a*. As indicated by two-dot chain lines in FIG. 3, the mounting ports 71 are exposed as the door 1*e* rotates. Through the mounting ports 71, the cartridges 4 can be mounted to the cartridge mounting portions 70, and can be detached from the cartridge mounting portions 70 and replaced with new ones.

As shown in FIG. 4, each cartridge mounting portion 70 has a rearmost wall 70*a* that faces a leading edge of the cartridge 4 when a user inserts the cartridge 4 into the cartridge mounting portion 70 in the mounting direction along the front-rear direction. A step portion 72 is provided in one left edge (main-scanning direction edge) of the rearmost wall 70*a*. A hollow needle 73 is provided at the step portion 72 to extend in the front-rear direction, that is, along the mounting direction. A pipe 74 is connected to a base end of the hollow needle 73. One pipe 74 that is connected to a hollow needle 73 of the upper cartridge mounting portion 70 is connected to the sub-tank 80 corresponding to the head (pre-coating head) 10 that is positioned on the upstream side in the sheet conveying direction. The other pipe 74 that is connected to a hollow needle 73 of the lower cartridge mounting portion 70 is connected to the sub-tank 80 corresponding to the ink-jet head 10. The pipes 74 and the hollow needles 73 constitute liquid transferring portions for transferring liquid from the cartridges 4 to the sub-tanks 80. The tip ends of the hollow needles 73 serve as connecting portions to connect the liquid transferring portions with the cartridges 4. The pipes 74 and the hollow needles 73 (liquid transferring portions and the connecting portions) are disposed at the left edge side in the upper casing 1*a*. Thus, in terms of the main scanning direction, the pipes 74 and the hollow needles 73 (liquid transferring portions and the connecting portions) are disposed on the same side with the sub-tanks 80. Therefore, the lengths of the pipes 74 can be shortened.

In terms of the mounting direction (sub-scanning direction/front-rear direction), the rearmost walls 70*a* of the cartridge mounting portions 70 are disposed between the mounting ports 71 and the heads 10. That is, in terms of the mounting direction, as shown in FIGS. 3 and 4, the heads 10 and the sub-tanks 80 are disposed between the shafts 1*x* and the cartridges 4 mounted in the cartridge mounting portions 70.

As shown in FIG. 4, the cartridges 4 are substantially in the shape of a rectangular parallelepiped, and are long in the main scanning direction. In terms of the main scanning direction, the cartridges 4 mounted in the cartridge mounting portions 70 are disposed so as to overlap with the heads 10 when seen in the sub-scanning direction. The insides of the cartridges 4 are filled with liquid. A liquid supply portion 4*a* projects from a left end portion of each cartridge 4 (one end portion of the cartridge 4 in the main scanning direction). The liquid supply portion 4*a* projects in the mounting direction along the front-rear direction. A spout made of rubber is provided on a terminal end surface of the liquid supply portion 4*a*. As the cartridge 4 is mounted into a cartridge mounting portion 70, the liquid supply portion 4*a* is positioned in the step portion 72, and a hollow needle 73 is inserted into the spout. As a result, liquid inside the cartridge 4 is supplied to the sub-tank 80 via the hollow needle 73 and the pipe 74.

The first sheet supply portion 1*c* is disposed below the head unit 9 and the platens 44 and 45. So, the paths R1-R3 are in the reverse S shape. Accordingly, the printer 1 is small in a planar size. As a result, the installation area of the printer 1 is small.

The first sheet supply portion 1 c includes a sheet supply tray 20 and a sheet supply roller 21. As shown in FIG. 3, the sheet supply tray 20 can be attached to and removed from the lower casing 1*b* in the sub-scanning direction via an insertion opening 1*b*4 that is formed in the lower casing 1*b*. In terms of the sub-scanning direction, the insertion opening 1*b*4 is formed at a side surface (i.e. the front surface of the lower casing 1*b*) that is farthest away from the shafts 1*x* in the lower casing 1*b*. The sheet supply tray 20 is in a box shape that is open upward, and is able to store paper sheets P. The sheet supply roller 21 rotates under the control of the control unit 100, and sends a top paper sheet P among those stored in the sheet supply tray 20.

The second sheet supply portion 1*d* includes the manual feed tray 22 (door 22) and a sheet supply roller 23, and is for supplying a paper sheet from a middle portion of the path R1. The manual feed tray 22 is a plate-like member that is supported by the lower casing 1*b* so as to be rotatable between a sealing position (or the position shown in FIG. 1) where an opening 1*ab* formed on the front surfaces of the upper and lower casings 1*a* and 1*b* is covered, and an opening position (or the position shown in FIG. 2) where the opening 1*ab* is opened.

Usually, the second sheet supply portion 1*d* is not used. So, the manual feed tray 22 is placed at the sealing position, and is accommodated in the opening 1*ab* (which is an opening of a size that is large enough to accommodate the manual feed tray 22). That is, when being accommodated in the opening 1*ab*, the manual feed tray 22 is part of the front surfaces of the upper and lower casings 1*a* and 1*b*. As the manual feed tray 22 is rotated and opened as shown in FIG. 2, the second sheet supply portion 1*d* becomes available. At this time, if paper sheets P of predetermined sizes are disposed on the manual feed tray 22 and the sheet supply roller 23 is driven to rotate under the control of the control unit 100, the top paper sheet P, among those disposed on the manual feed tray 22, is sent to the path R1 via the path R4.

Under the control of the control unit 100, the paper sheet P sent from the first sheet supply portion 1*c* is conveyed through the paths R1 and R2. The paper sheet P sent from the second sheet supply portion 1*d* is conveyed from the path R4 to the path R2 via the path R1. The paper sheet P passes just below the heads 10 (recording positions), while being supported on the upper surface of the platens 44 and 45. At this time, under the control of the control unit 100, the heads 10 each are driven to eject liquid from the ejection nozzles in the liquid ejection surfaces 10*a* toward the paper sheet P. As a result, an image is formed on the paper sheet P. Then, the paper sheet P is conveyed along the path R3 before being discharged on the sheet discharging portion 31.

As shown in FIG. 3, the sheet discharging portion 31 is an upper surface of the upper casing 1*a*. In the upper casing 1*a*, the front edge of the upper surface is connected to an upper edge of the front surface of the upper casing 1*a*. The mounting ports 71 of the cartridge mounting portions 70 are formed in the front surface. The sheet discharging portion 31 is positioned above the heads 10. That is, the sheet discharging portion 31 is positioned in such a way that the head unit 9 is sandwiched between the sheet discharging portion 31 and the platens 44 and 45. Therefore, even when a paper sheet P remains on the sheet discharging portion 31, the cartridges 4 can be mounted into the cartridge mounting portions 70.

Next will be described with reference to FIGS. 5A and 5B, how the ink-jet printer 1 operates when the upper casing 1*a* is rotated from the proximity position to the separation position.

Figure 5B:
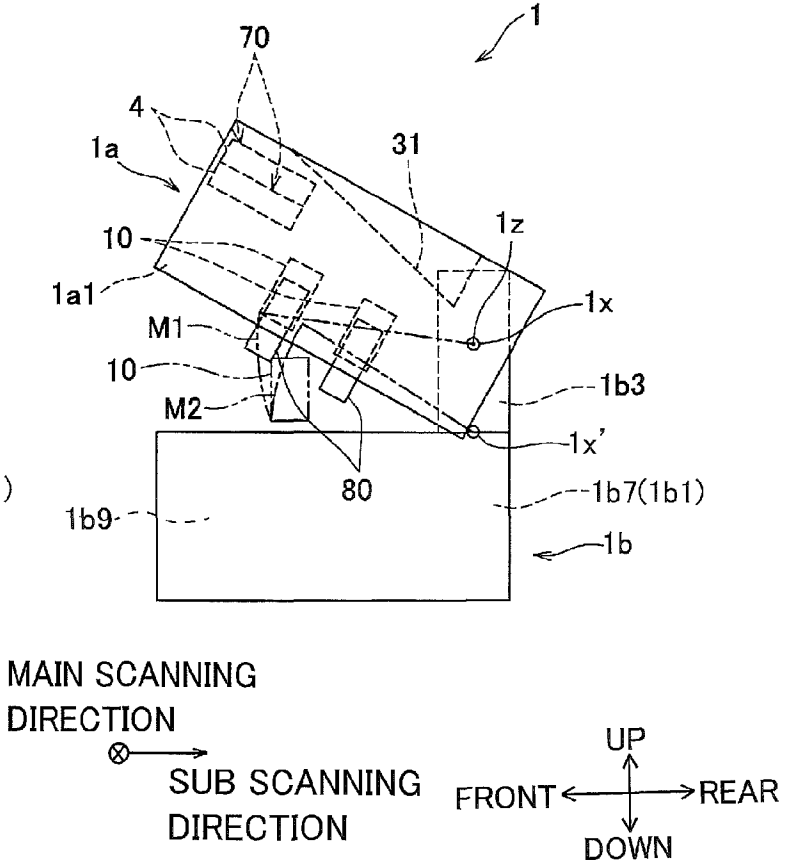
Figure 5A:
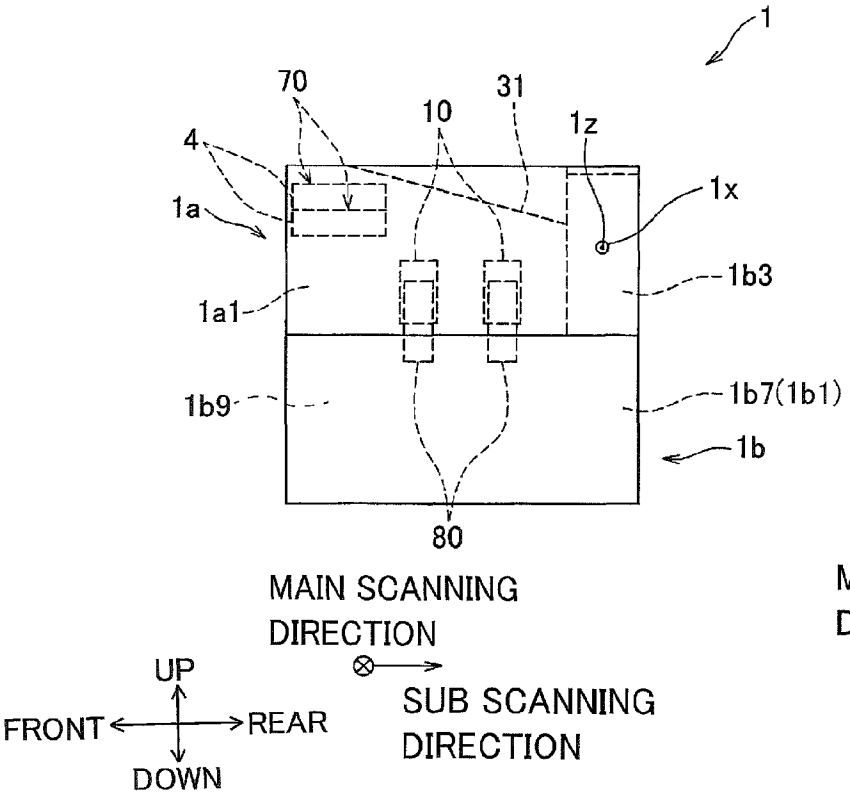

According to the embodiment, as shown in FIGS. 5A and 5B, when the upper casing 1*a* is rotated to the separation position, the heads 10 move along a rotation trajectory M1 indicated by a two-dot chain line in FIG. 5B. That is, the heads 10 move in a direction in which the heads 10 move away from the shafts 1*x* in terms of the front-rear direction (sub-scanning direction). In other words, the heads 10 move forwardly in terms of the front-rear direction. This is because the shafts 1*x* (axis 1*z*) are disposed at a position higher than the liquid ejection surfaces 10*a* in terms of the vertical direction.

Now assume that the shafts lx were at a position lower than the liquid ejection surfaces 10*a* as indicated by a reference numeral (1*x*') in FIG. 5B in terms of the vertical direction. In such a case, when the upper casing 1*a* is rotated to the separation position, the heads 10 will move along a rotation trajectory M2 also indicated by a two-dot chain line in FIG. 5B. That is, the heads 10 move in a direction in which the heads 10 approach the shafts 1*x* in terms of the sub-scanning direction. In other words, the heads 10 move rearwardly in terms of the front-rear direction.

According to the present embodiment, the shafts 1*x* are located at a level higher than the liquid ejection surfaces 10*a* in the vertical direction. So, when the upper casing 1*a* is rotated to the separation position, the heads 10 move toward the front end of the ink-jet printer 1 where the upper casing 1*a* departs from the lower casing. A user accesses the front surface of the printer 1 when rotating the upper casing 1*a* to the separation position and carrying out the jam operation and the maintenance of the heads. Therefore, the user can easily carry out the maintenance of the heads 10.

Furthermore, the amount of the rotation angle by which the upper casing 1*a* has to be rotated from the proximity position to the separation position is smaller when the shafts 1*x* are positioned at a level higher than the liquid ejection surfaces 10*a* in the vertical direction than when the shafts 1*x* are positioned at a level lower than the liquid ejection surfaces 10*a* or on the same level with the liquid ejection surfaces 10*a* in terms of the vertical direction. Therefore, according to the present embodiment, even if paper sheets P remain on the sheet discharging portion 31, the paper sheets P are unlikely to fall therefrom.

The heads 10 and the sub-tanks 80 are retained in the upper casing 1*a* in such a way that the heads 10 and the sub-tanks 80 are arranged side by side in terms of the main scanning direction. Accordingly, as shown in FIG. 5B, when the upper casing 1*a* is rotated to the separation position, the water head difference between the heads 10 and the sub-tanks 80 can hardly become larger. Therefore, liquid meniscuses formed near the ejection nozzles are unlikely to be damaged.

Next will be described, with reference to FIG. 6, the configuration of the sheet discharge tray 200, as well as how the ink-jet printer 1 operates when the sheet discharge tray 200 is added to the printer 1.

The sheet discharge tray 200 includes a sheet discharging portion 201, a conveying mechanism 240, a connection terminal (not shown), and a casing 200*a*. The sheet discharging portion 201 is for supporting a paper sheet P discharged from the inside of the printer 1. The conveying mechanism 240 includes a conveying motor, and components (described below) defining a path R6. The connection terminal is for electrically connecting the conveying motor of the conveying mechanism 240 to the control unit 100. The casing 200*a* supports the sheet discharging portion 201, conveying mechanism 240, and connection terminal (not shown).

The path R6 extends from the path R5 to the sheet discharging portion 201. The path R6 is defined by guides 202 and 203 and a pair of rollers 204 and a pair of rollers 205.

A projecting portion 210 projects downward from the casing 200*a*. Four L-shaped engagement portions 211 are formed on the projecting portion 210. The lower-casing connection frame 1*b*8 is formed with two mounting through-holes 1*b*5. By inserting the engagement portions 211 into the mounting through-holes 1*b*5, the sheet discharge tray 200 is attached to the lower casing 1*b* of the printer 1. At this time, the connection terminal is electrically connected to a terminal that is connected to the control unit 100 of the printer 1. As a result, the control unit 100 becomes able to control the conveying motor of the conveying mechanism 240. Moreover, at this time, the paths R5 and R6 are connected together. In this manner, the sheet discharge tray 200 is mounted on the lower casing 1*b*. Therefore, even when the upper casing 1*a* is rotated, the sheet discharge tray 200 does not tilt. Accordingly, when the upper casing 1*a* is rotated to the separation position, the paper sheets P remaining on the sheet discharging portion 201 do not fall therefrom. Moreover, compared with the case where the sheet discharge tray 200 were added to the upper casing 1*a*, the conveying paths become simple. More specifically, if the sheet discharge tray 200 were added to the upper casing 1*a*, a path connecting the sheet discharging portion 201 to the path R5 will also rotate when the upper casing 1*a* is rotated. So, the configuration of the path connecting the sheet discharging portion 201 to the path R5 will become extremely complicated. Contrarily, according to the embodiment, the sheet discharge tray 200 is attached directly to the lower casing 1*b*, and therefore the configuration of the connecting portion of connecting the paths R6 and R5 becomes simple. Moreover, compared with the case where the sheet discharge tray 200 were added to the upper casing 1*a*, it is unnecessary to increase the size of the shafts 1*x*. This is because the weight of the sheet discharge tray 200 is not applied to the shafts 1*x* according to the present embodiment.

In order to discharge a paper sheet P onto the sheet discharging portion 201 under control of the control unit 100, the conveying motor of the conveying mechanism 240 is driven, and the pairs of rollers are driven to rotate. The switching mechanism 69 is controlled so that the swing member 69*a* is placed at the second position. As a result, a paper sheet P that has been conveyed from the path R3 to the path R5 is discharged to the sheet discharging portion 201 via the path R6.

Figure 6:
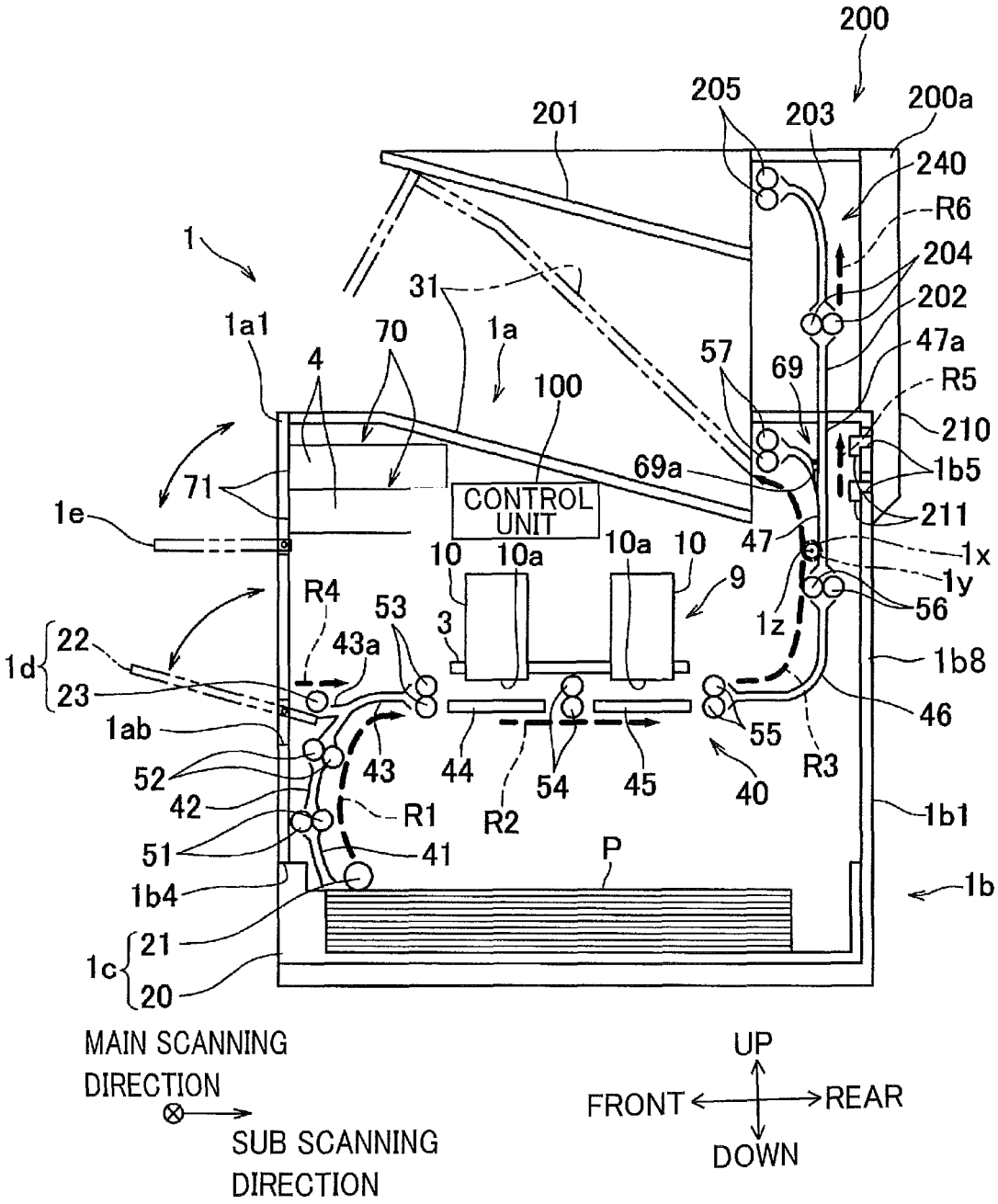
FIG. 6 is a schematic side view schematically showing the internal configuration of the printer when a discharge tray is added to the printer.

Moreover, as indicated by two-dot chain lines in FIG. 6, when the upper casing 1*a* is rotated to the separation position, the upper front edge of the upper casing 1*a* comes in contact with the sheet discharging portion 201 of the sheet discharge tray 200. Accordingly, the sheet discharging portion 201 serves as a stopper for restricting the upper casing 1*a* from being opened too much. As a result, the paper sheets P remaining on the sheet discharging portion 31 are unlikely to fall therefrom.

As described above, in the printer 1 of the present embodiment, all the components that make up a liquid supply system extending from the cartridges 4 to the heads 10 (the cartridges 4, the cartridge mounting portions 70, the sub-tanks 80, the heads 10, and the pipes 74 and 81) are accommodated in the upper casing 1*a*. Therefore, the liquid supply system is made compact.

In the upper casing 1*a*, the heads 10 and the sub-tanks 80 are placed closer to the shafts 1*x* than the cartridges 4 mounted in the cartridge mounting portions 70 are in terms of the front-rear direction (sub-scanning direction). If the cartridges 4 were placed closer to the shafts 1*x* than the heads 10 and the sub-tanks 80 in terms of the sub-scanning direction, the distance, by which the heads 10 and the sub-tanks 80 travel when the upper casing 1*a* is rotated to the separation position, will increase. Changes in the liquid surface levels in the heads 10 and the sub-tanks 80 will become larger. However, according to the present invention, the distance the heads 10 and the sub-tanks 80 travel when the upper casing 1*a* is rotated is relatively short, thereby restraining changes in the liquid surface levels in the heads 10 and the sub-tanks 80. Liquid is unlikely to leak, and air bubbles are unlikely to get mixed into the liquid.

Furthermore, the mounting ports 71 of the cartridge mounting portions 70 are formed on the front side of the printer 1 (access side) where the upper casing 1*a* departs from the lower casing 1*b* when the upper housing 1*a* is rotated to the separation position). A user does not have to change the orientation of the printer 1 when mounting the cartridges 4 in the cartridge mounting portions 70 and when carrying out a jam operation.

The conveying mechanism 40 that makes up the conveying path (paths R1 to R3) extending from the first sheet supply portion 1*c* to the sheet discharging portion 31 is retained by the lower casing 1*b*. Therefore, even when the upper casing 1*a* is rotated, the conveying path is not divided into two or more portions. Accordingly, the operation of conveying a paper sheet P is unlikely to fail. Moreover, since the conveying mechanism 40 is not retained by the upper casing 1*a*, the overall weight of the upper casing 1*a* becomes light. It is unnecessary to increase the size of the shafts 1*x* that support the upper casing 1*a*.

The insertion opening 1*b*4, into which the sheet supply tray 20 is inserted, is formed on the front surface (access side) of the lower casing 1*b*. Therefore, a user does not have to change the orientation of the printer 1 when mounting the cartridges 4, when carrying out a jam operation or other kinds of maintenance, and when mounting the sheet supply tray 20. The user can handle the printer 1 easily. Moreover, the manual feed tray 22 is provided on the front surface (access side) of the printer 1. Therefore, a user does not have to change the orientation of the printer 1 when placing paper sheets P on the manual feed tray 22. As a result, the user can handle the printer 1 more easily.

While the invention has been described in detail with reference to the embodiment thereof, it would be apparent to those skilled in the art that various changes and modifications may be made therein without departing from the spirit of the invention.

For example, when the upper casing 1*a* is in the proximity position, the shafts 1*x* (axis 1*z*) may be disposed at the same level as the liquid ejection surfaces 10*a*, or at a level lower than the liquid ejection surfaces 10*a*, in terms of the vertical direction.

The heads 10 and the cartridge mounting portions 70 may be short in terms of an axial direction in which the axis 1*z* extends (left-right direction). The heads 10 and the cartridge mounting portions 70 may not overlap with each other in terms of the axial direction in which the axis 1*z* extends (left-right direction).

The heads 10 and the sub-tanks 80 can be placed in any other positions in the upper casing 1*a* as long as the heads 10 and the sub-tanks 80 are disposed between the shafts 1*x* and the cartridges 4 mounted in the cartridge mounting portions 70.

The sheet discharging portion 31 may be supported by the lower casing 1*b*.

The insertion opening 1*b*4 for the sheet supply tray 20 may be formed on a side surface of the printer 1 other than the front surface.

The manual feed tray may be formed on a surface of the printer 1 other than the front surface.

The configuration of the liquid transferring portions may be of any type as long as the liquid transferring portions can transfer liquid from the cartridges 4 to the sub-tanks 80.

The present invention can be applied not only to black and white printers but also to color printers.

Moreover, the present invention is not limited to printers. The present invention can also be applied to facsimile machines and copy machines.

The heads may eject any liquid other than ink.

The recording apparatus may include only one head.

A recording medium is not limited to paper sheets S, but may be any other recordable medium.

The platens 44 and 45 and the pair of rollers 54 may be replaced with a belt conveying mechanism. The belt conveying mechanism is retained by the lower casing 1*b*. In the belt conveying mechanism, an endless belt is stretched between at least two rollers that are arranged in the sheet conveying direction as being separate away from one another. The upper surface of the belt moves in the sheet conveying direction as the rollers are driven to rotate. The belt therefore conveys the sheet of paper P in the sheet conveying direction, while supporting the sheet of paper P on its upper surface. Thus, the belt serves as part of the conveying mechanism 40, and also serves as a supporting portion that confronts the heads 10 and supports the sheet of paper P.

What is claimed is:

1. A recording apparatus comprising:

a supporting portion that is configured to support a recording medium;

a recording head that has an ejection surface formed with ejection openings, through which the recording head ejects liquid, the recording head being configured to record an image on a recording medium supported by the supporting portion by ejecting liquid from the ejection openings;

a first tank configured to store liquid to be supplied to the recording head;

a first casing that holds the supporting portion;

a second casing that holds the recording head and the first tank, the second casing being connected to the first casing so as to be rotatable relative to the first casing about a prescribed axis, the second casing being configured to move between a first position and a second position by rotating relative to the first casing, the recording head being located adjacent to the first casing when the second casing is in the first position, the recording head being further apart from the first casing when the second casing is in the second position than when the second casing is in the first position, the recording head opposing the supporting portion when the second casing is in the first position, the second casing being provided with:

a second tank mounting portion, into which a second tank is detachably mountable, the second tank being configured to store liquid; and a liquid transferring portion configured to transfer liquid from the second tank mounted in the second tank mounting portion to the first tank.

2. The recording apparatus as claimed in claim 1, wherein a first direction is defined as being perpendicular to the axis and being parallel with the ejection surface of the recording head, the axis is positioned on one edge side of the second casing in the first direction, and the second tank mounting portion is positioned on another edge side of the second casing in the first direction opposite to the edge side where the axis is positioned, the recording head and the first tank are positioned between the axis and the second tank mounting portion with respect to the first direction.

3. The recording apparatus as claimed in claim 1, wherein the recording head and the second tank mounted in the second tank mounting portion are elongated in an axial direction in which the axis extends, and the recording head and the second tank mounted in the second tank mounting portion are at least partly overlapped with respect to the axial direction when seen from the first direction.

4. The recording apparatus as claimed in claim 1, wherein all of the first tank, the liquid transferring portion, and a connecting portion connecting the liquid transferring portion with the second tank are positioned at one edge side in the second casing relative to a center of the second casing with respect to an axial direction in which the axis extends.

5. The recording apparatus as claimed in claim 1, wherein the recording head and the first tank are arranged side by side in an axial direction in which the axis extends.

6. The recording apparatus as claimed in claim 1, wherein the second casing further includes a discharging portion onto which the recording medium on which an image has been recorded by the recording head is discharged, a first direction is defined as being perpendicular to the axis and being parallel with the ejection surface of the recording head, the discharging portion is provided on a first external surface of the second casing, the recording head being located between the first external surface and a surface of the supporting portion on which the recording medium is supported, the second casing has first-direction intersecting external surfaces that intersect with the first direction, a second tank mounting portion has a mounting port through which the second tank is mounted into and detached from the second tank mounting portion, the mounting port being formed in a second external surface of the second casing, the second external surface intersecting with the first external surface and being one of the first-direction intersecting surfaces that is most apart from the axis with respect to the first direction among the first-direction intersecting external surfaces.

7. The recording apparatus as claimed in claim 1, wherein the first casing is positioned at a level lower than the second casing with respect to a vertical direction, and the first tank is positioned at a level lower than the second tank mounted in the second tank mounting portion with respect to the vertical direction.

8. The recording apparatus as claimed in claim 1, wherein the first casing includes:

a tray configured to accommodate recording medium, on which an image is to be recorded by the recording head; and a tray accommodating portion, into which the tray is detachably mountable, a first direction is defined as being perpendicular to the axis and being parallel with the ejection surface of the recording head, the first casing includes first-direction intersecting external surfaces that intersect with the first direction, the first casing includes a tray insertion opening through which the tray is mountable into and detachable from the tray accommodating portion, the tray insertion opening being formed in an access-side external surface of the first casing, the access-side external surface being one of the first-direction intersecting external surfaces that is most apart from the axis with respect to the first direction among the first-direction intersecting external surfaces.

9. The recording apparatus as claimed in claim 8, wherein the access-side external surface of the first casing is formed with a manual feed opening, a manual feed tray is provided on the access-side external surface of the first casing so as to be rotatable relative to the first casing between a closing position closing the manual feed opening and an opening position opening the manual feed opening, the manual feed tray being configured so that recording medium is mountable on the manual feed tray when the manual feed tray is in the opening position, the first casing is provided with a manual-feed recording medium conveying path along which the recording medium is conveyed from the manual feed tray to the supporting portion.

* * * * *

UNITED STATES PATENT AND TRADEMARK OFFICE

CERTIFICATE OF CORRECTION

PATENT NO. : 8,767,065 B2
APPLICATION NO. : 13/627767
DATED : July 1, 2014
INVENTOR(S) : Shinya Yamamoto It is certified that error appears in the above-identified patent and that said Letters Patent is hereby corrected as shown below:

Title Page, item (71), Line 1:

Change "Shinya Yamamoto, Nagoya (JP)" to --Brother Kogyo Kabushiki Kaisha, Nagoya-shi, Aichi-ken (JP)--.

Signed and Sealed this
Twenty-fifth Day of November, 2014

Michelle K. Lee

Michelle K. Lee
*Deputy Director of the United States Patent and Trademark Office*